United States Patent [19]

Shore et al.

[11] 4,301,634

[45] Nov. 24, 1981

[54] MANUFACTURE OF TILES

[75] Inventors: John W. Shore, Over Alderley; James H. Eyres, Paignton; Kenneth Critchley, Swinton, all of England

[73] Assignee: Pilkington's Tiles Limited, Manchester, England

[21] Appl. No.: 116,236

[22] Filed: Jan. 28, 1980

Related U.S. Application Data

[63] Continuation of Ser. No. 937,178, Aug. 28, 1978, abandoned.

[51] Int. Cl.[3] ..... E04F 13/08

[52] U.S. Cl. ..... 52/389; 52/392; 52/603

[58] Field of Search ..... 52/389, 392, 603

[56] References Cited

U.S. PATENT DOCUMENTS

| | | | |
|---|---|---|---|
| 926,282 | 6/1909 | Nicholls | 52/603 X |
| 1,694,665 | 12/1928 | Parker | 52/603 X |
| 2,111,003 | 3/1938 | Petty | 52/603 |
| 2,207,454 | 7/1940 | Brierly | 52/603 X |
| 2,904,990 | 9/1959 | Emmerling | 52/392 X |

FOREIGN PATENT DOCUMENTS

| | | | |
|---|---|---|---|
| 1420325 | 1/1976 | United Kingdom | 52/392 |

*Primary Examiner*—Carl D. Friedman

*Attorney, Agent, or Firm*—Norris & Bateman

[57] ABSTRACT

An assembly of glazed ceramic tiles for the interior walls and ceilings each tile comprising a glazed body with glazed spacing lugs on all four sides of the tile at least two of the glazed lugs on two sides extending substantially the full length of the sides and two glazed lugs on the other two sides extending substantially the full length of the sides or two shorter glazed lugs symmetrically arranged thereon one of each of the shorter lugs being longer than the other, all the glazed lugs on all the sides when assembled engaging glazed lugs on adjacent sides.

4 Claims, 8 Drawing Figures

MANUFACTURE OF TILES

This is a continuation of application Ser. No. 937,178, filed Aug. 28, 1978, abandoned.

This invention relates to improvements in ceramic tiles.

In the manufacture of tiles for the walls and ceilings of buildings and similar structures, a number of differing tiles have been proposed:

1. Tiles have been produced with a glazed surface and with unglazed spacer lugs around the edges to define the width of the joint between adjacent tiles but such tiles can only be used as "field" tiles for the main body of a tiled area and require further tiles with a single or double rounded glazed edge or edges to finish off the edges of the tiled area and for use on window sills, corners etc..

A tile has been described in U.S. Pat. No. 1,694,665 Parker in which along each edge of the tile a slight projection is formed which is integral with the tile material but does not extend completely up the side of the tile but only approximately one half the height thereof and the tiles are only applicable as field tiles as the glazing does not extend over the projections. A further tile is described in British Specification No. 1,420,325 in which the glazed edges on one or two sides are not formed with projections or lugs and the projection or lugs on the edges of the other sides are assymetrically positioned so that when the edges of two tiles with projections are placed adjacently parallel the projections of the respective tiles are offset so that on assembly they are not in contact and are selectively assembled.

2. On the Continent tiles are used with square edges and no spacer lugs and glazed over the surface and two of the edges can be used as a field tile or an edging tile. As a result most European distributors and manufacturers run only one basic tile in a given pattern or colour rather than the three involved in the spacer lug plus rounded edge and double rounded edge system. This system has obvious advantages to the tile distributor and manufacturer but it has a major disadvantage that fixing of non-lug tiles takes longer than fixing spacer lug tiles and is generally confined to more expert tiling contractors, since the semi-skilled and unskilled find it difficult to fix tiles satisfactorily unless they have spacer lugs to predetermine the joints.

3. As a varient of the glazed edge tiles it has been proposed to employ spacer lug tiles in combination with border tiles i.e. tiles with glazed edges as described in connection with Continental tiles with the reduction in manufacture and stocking from three tiles to two by eliminating the rounded edge or double rounded edges tiles. As far as the distributor and customer is concerned however, the customer is provided with an inferior article since a glazed edge is not as aesthetically satisfying as a round edge tile—but it saves the distributor having to stock double rounded edges tiles. Since the number of double rounded edge tiles used in a tiling area is very small, the saving of this particular item is not of major benefit to a distributor. However, this variant becomes more attractive with rectangular tiles or where the tile carries a directional design. Instead of having to stock four different items of fittings i.e. rounded edge on the long side, rounded edge on the short side, left hand corner tiles and right hand corner tiles, the border tiles properly organised would meet all these requirements. In the case of a rectangular tile, wherefore, the spacer lug plus border tile eliminates three items and reduces the number of items per tile to be stocked from five to two.

4. A tile has also been proposed having two adjacent edges with spacer lugs and the two other adjacent edges completely glazed over with no spacer lugs. The spacer lugs used are twice the width of the small lug on ordinary spacer tiles and are intended to be placed adjacent to a non-lug glazed edge thus providing the correct width of joint. The edge of the tiling is completed by ensuring that the glazed edge appears and where corners are required a double glazed edge appears. The disadvantages of this system are firstly that the tile has to be glazed in a particular direction, secondly every tile must be examined before it is put upon the wall with the lugs provided in a common direction, thirdly it is impossible to use directional patterns with this system since the tile must always be put on the wall in one direction; fourthly the large lug is more easily damaged than the normal size lug and fifthly the glazed edge is just as unattractive as the glazed edge of the Continental tile.

The system described in paragraph 1 provided the best finish i.e. using spacer lug field tiles for the main area with rounded or double rounded edge tiles for the edge of the tiled area but is at a disadvantage from storage consideration.

According to the invention an assembly of ceramic tiles for interior walls and ceilings is made up of a plurality of tiles arranged in rows each tile comprising a four sided glazed face and edges, projecting glazed spacing lugs on each edge of the tile and extending upwards substantially one half the thickness of the tile from the base and having a width of approximately 0.05", adjacent tiles employed as field tiles being assembled with the glazed lugs on one tile engaging the glazed lugs on the adjacent tiles and long glazed lugs extending substantially the whole length of at least two sides of each tile employed as glazed edge border tiles whereby the same glazed edge tiles may be employed as field and border tiles, the glazed lugs providing compressible portions which will crush to take up initial movements on any settling movement of the building so that the tiles do not leave the wall.

The invention will be described with reference to the accompanying drawings.

Figure 7:
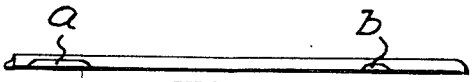
FIG. 7 (PRIOR ART)
FIG. 7 is a side elevation of a conventional tile with unglazed projections or lugs.
Figure 8:
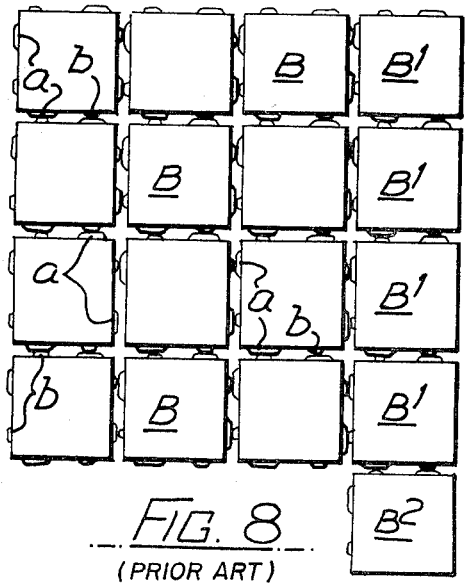
FIG. 8 (PRIOR ART)
FIG. 8 is a plan of an assembly of the conventional tiles having short lugs on all four sides for field tiles and no projections or lugs on one side for border tiles and no projections or lugs on two sides on two sides of a tile $B^2$ for corner tiles.

The essential feature of the assembly of the tiles shown in FIGS. 1–6 combines the benefits of the traditional spacer lug tile and the benefit of the tile system depending on only one type of tile and on the traditional spacer lug tile. At the present time there are two basic tile systems in the world. Countries which use the spacer tile have traditionally used the type shown in FIGS. 7 and 8. Continental manufacturers manufacture tiles without spacer lugs and this has enabled them to use a glazed over edge in place of trim and to reduce their system to a one tile construction for both field and border tiles.

The tiles of FIGS. 1–6 combine the advantages of both systems. The tiles incorporate spacer lugs on the edges of the tile but at the same time they allow for a one tile system for field and border tiles since by overglazing at least two of the edges the need for trim is obviated.

Spacer lugs are provided on tiles to provide for accurate jointing and for speed of tile laying. At the same time lugs are sufficiently compressible to take up initial movement on any settling movement of the building so that the tiles do not leave the wall as the lugs crush more readily than the main body of the tile. If the spacer lug tiled area is subject to this movement in the backing wall the first result of compression being applied to the tiling area is that the spacer lugs will crush and the tiles will remain on the wall thus providing a built-in safety feature. The provision of tiles shown in FIGS. 1 and 3 enables a dealer to only stock either the FIG. 1 or the FIG. 3 tile. These tiles are thus significantly different from the traditional tiles in that it dispenses with the need for any trim whilst retraining all the advantages of such tiles with the added difference of the compressible lugs.

The tiles can be assembled and placed on a wall as field tiles in any random positioning and are applicable as border tiles.

Figure 1:
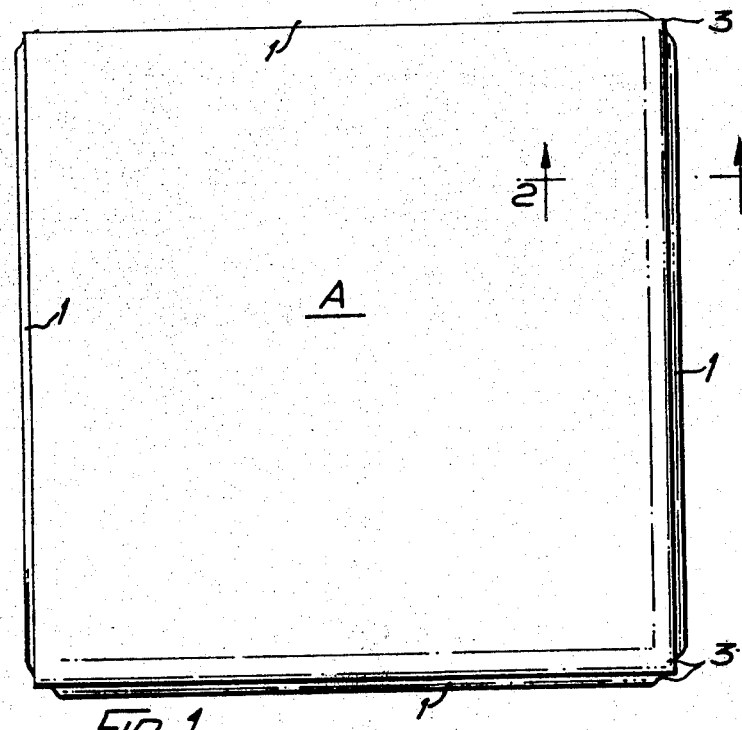
FIG. 1 is a plan of a tile having a lug along each side.
Figure 2:
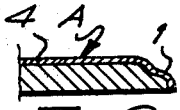
FIG. 2 is a section on line 2—2 FIG. 1 to a larger scale.

As shown in FIGS. 1 and 2 a tile is formed with spacing lugs 1 along each side 2 the lug 1 extending up to within a short distance 3 of the corners. The surface of the tile and the lugs 1 are covered by a layer of glaze 4 in order that the tiles may be employed as field tiles to cover the main area and as a border tile with the glazed lugs 1 replacing round edges or double around edge tiles. The glazed lug 1 is not prominent and provides an acceptable standard of finish for an edging tile.

The lug 1 terminates short of the corners to enable the same tile to be used as a field tile or as an edging tile as shown in FIG. 1.

Figure 3:
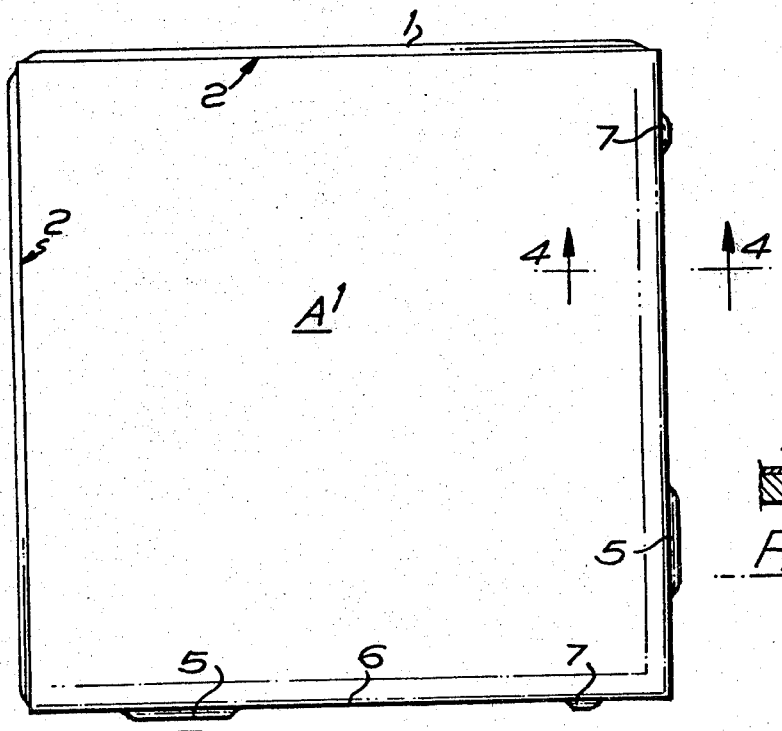
FIG. 3 is a plan of a modified tile having a long lug on two sides and short lugs on the other two sides.
Figure 4:
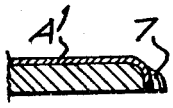
FIG. 4 is a section on line 4—4 FIG. 3 to a larger scale.
Figure 5:
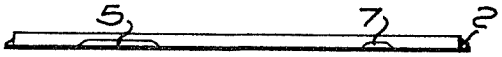
FIG. 5 is a side elevation of the tile shown in FIG. 4.
Figure 6:
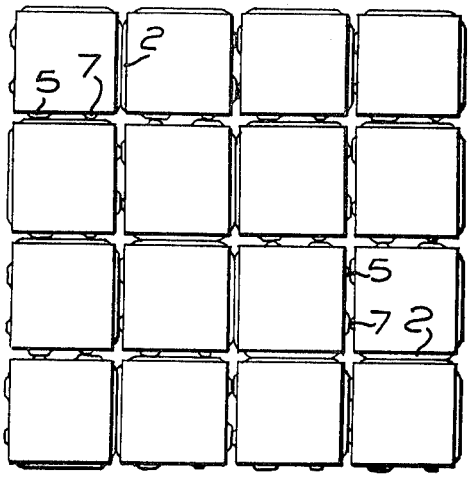
FIG. 6 is a plan of an assembly of the tiles shown in FIG. 4.

As shown in FIGS. 3 and 4 a square tile $A^1$ is formed as in FIGS. 1 and 2 with long lugs 1 extending along two adjacent sides 2 and with a shorter lug 5 about $\frac{3}{8}''$ in length adjacent one end of the remaining two sides adjacent one corner of each side 6 and with a spacer lug 7 about $\frac{1}{8}''$ in length adjacent the opposite corners of the adjacent sides 6 to provide the advantages of the tile A shown in FIGS. 1 to 2 with the lugs 5, 7 of FIGS. 3 and 4 having in addition some compressability to resist adhesion failure due to building movement.

The lugs 5 of FIGS. 3 and 4 engage the lugs 7 on an adjacent tile and both lugs 5 and 7 can engage long lugs 1 on an adjacent tile.

A tile formed in accordance with the invention has the following advantages:

1. It provides one tile which meets the requirement for both the main field area of tiling and the border;

2. It can be fixed in any position upon the wall for a non-directional design and it can also be used for a directional design and still retain only one tile instead of up to five;

3. It has an improved appearance compared with an ordinary glazed edge tile;

4. It substantially reduces the holding required by the distributors and/or manufacturer; and has a similar advantage in simplifying the manufacturing process;

5. It reduces the cost of tiling by eliminating the larger expense of rounded or double rounded edgetiles;

6. It simplifies ordering and purchasing at all stages in the chain of supply;

7. It retains all the benefits of the self spacing tile system.

What we claim is:

1. An assembly of ceramic tiles for interior walls and ceilings made up of a plurality of tiles arranged in rows, each and every tile of said assembly selectively being either a field tile or a border tile, each tile comprising: a four sided glazed face and edges; and projecting glazed spacing lugs on each edge of the tile and extending upwards substantially one half the thickness of the tile from the base and having a width of approximately 0.05", adjacent tiles employed as field tiles being assembled with the glazed lugs on one tile abutting the glazed lugs on the adjacent tiles and long glazed lugs extending substantially the whole length of at least two sides of each tile whereby the same glazed edge tiles may be employed as field or border tiles, said tiles being employed as field tiles being arrangeable in any conceivable random fashion with respect to abutment of adjacent edges thereof, the glazed lugs providing compressible portions which will crush to take up initial movement on any settling movement of the building so that the tiles do not leave the wall.

2. An assembly of ceramic tiles as in claim 1 in which each tile comprises a four sided glazed body, projecting glazed spacing lugs extending substantially the full length of each side of the tile and terminating short of the corners formed by the intersection of adjacent sides.

3. An assembly of ceramic tiles as in claim 1 in which each tile comprises a four sided glazed body, projecting glazed spacing lugs extending substantially the full length of two adjacent sides of the tile but terminating short of the corners formed by the intersection of adjacent sides, and two spaced short lugs projecting symmetrically from each of the other two adjacent sides, each of said shorter lugs being spaced from the adjacent corners formed by the intersection of adjacent sides, one of said shorter lugs on each of the other sides being longer than the other, with the said longer of said shorter lugs located adjacent the intersections of the sides of the body and with said shorter lugs being symmetrically located adjacent the intersection of the sides of the body so that on assembly the shorter lug on one tile engages the longer lug on an adjacent tile and viceversa.

4. An assembly of glazed tiles as in claim 1 in which all the glazed lugs on the four sides of each tile, on assembly engages the glazed lugs on adjacent tiles.

* * * * *